US008726807B2

(12) United States Patent
Vrotacoe et al.

(10) Patent No.: US 8,726,807 B2
(45) Date of Patent: May 20, 2014

(54) SMOOTH ROLLER WITH LOW LINE LOAD AND METHODS

(75) Inventors: James Brian Vrotacoe, Barrington, NH (US); Kent Dirksen Kasper, Dover, NH (US); David Robert Dawley, Rochester, NH (US)

(73) Assignee: Goss International Americas, Inc., Durham, NH (US)

( * ) Notice: Subject to any disclaimer, the term of this patent is extended or adjusted under 35 U.S.C. 154(b) by 1358 days.

(21) Appl. No.: 11/810,036

(22) Filed: Jun. 4, 2007

(65) Prior Publication Data

US 2008/0295717 A1 Dec. 4, 2008

(51) Int. Cl.

| | |
|---|---|
| ***B41F 27/06*** | (2006.01) |
| ***B41F 13/10*** | (2006.01) |
| ***B41C 3/08*** | (2006.01) |
| ***B41N 6/00*** | (2006.01) |

(52) U.S. Cl.
USPC ..... 101/376; 101/401.1; 101/375; 492/18

(58) Field of Classification Search
USPC ..... 101/376, 375, 401.1; 492/18, 17, 16, 28
See application file for complete search history.

(56) References Cited

U.S. PATENT DOCUMENTS

| | | | | | |
|---|---|---|---|---|---|
| 3,152,387 | A | * | 10/1964 | Macleod | 492/56 |
| 3,467,009 | A | | 9/1969 | Ross | |
| 4,378,622 | A | * | 4/1983 | Pinkston et al. | 29/895.21 |
| 4,527,471 | A | * | 7/1985 | Dahlgren et al. | 101/148 |
| 4,919,047 | A | | 4/1990 | Inouye et al. | |
| 5,253,579 | A | * | 10/1993 | Yoshii et al. | 101/401.1 |
| 5,257,967 | A | * | 11/1993 | Gysin | 492/56 |
| 5,376,448 | A | * | 12/1994 | Suzuki et al. | 428/382 |
| 5,415,612 | A | * | 5/1995 | Carlson et al. | 492/56 |
| 5,884,559 | A | * | 3/1999 | Okubo et al. | 101/376 |
| 6,058,837 | A | * | 5/2000 | Kamoda | 101/352.03 |
| 6,098,540 | A | | 8/2000 | Vrotacoe et al. | |
| 6,129,021 | A | | 10/2000 | Vrotacoe et al. | |
| 6,669,613 | B1 | * | 12/2003 | Van Denend | 492/49 |
| 2007/0272104 | A1 | * | 11/2007 | Burgio | 101/335 |
| 2009/0241789 | A1 | | 10/2009 | Baecker | |

FOREIGN PATENT DOCUMENTS

| | | |
|---|---|---|
| JP | 62-51453 | 3/1987 |
| JP | 62-68756 | 3/1987 |
| JP | 2000-52625 | 2/2000 |
| JP | 2003-225991 | 8/2003 |
| JP | 2007-331251 | 12/2007 |
| WO | WO 03/103967 A1 | 12/2003 |
| WO | WO 2008017700 A1 | 2/2008 |

* cited by examiner

*Primary Examiner* — Judy Nguyen
*Assistant Examiner* — Leo T Hinze
(74) *Attorney, Agent, or Firm* — Davidson, Davidson & Kappel, LLC

(57) ABSTRACT

An ink form roller in a printing press is provided including a core, a first layer surrounding part of the core, and a second layer surrounding part of the first layer, the second layer having a durometer hardness greater than the first layer. In addition, an ink form roller in a printing press is provided including a core, and a layer surrounding the core, the layer having a hardness between about 25 Shore A durometer and about 40 Shore A durometer, the layer having an outer surface, the outer surface having a surface roughness of about 30 micro-inches or less. Methods are also provided.

22 Claims, 3 Drawing Sheets

SMOOTH ROLLER WITH LOW LINE LOAD AND METHODS

BACKGROUND

The present invention relates generally to printing presses and more particularly to ink form rollers.

U.S. Pat. No. 6,098,540 discloses an apparatus and method having one or more form rolls having a hard elastomeric outer surface, in the range of approximately 60-90 Shore A durometer hardness used to transfer ink to the plate cylinder. The form rolls can be made of a convex shape along their axial length, such that the diameter of the hard elastomeric surface at its axial center is larger than the diameter of the hard elastomeric surface at its axial ends.

U.S. Pat. No. 6,129,021 discloses an offset printing apparatus having two smoothers. An ink fountain transfers ink to a metering roll. The metering roll transfers the ink to another distributing roller. The distributing roller then transfers the ink to vibrator roll which transfers ink to a swing roll. A smoother is associated with the vibrator roll and smoothes the ink just before transferring the ink to a second and a third ink form roller. A smoother is applied to the third ink form roller and smoothes the ink just before transferring the ink to a plate cylinder.

BRIEF SUMMARY OF THE INVENTION

The present invention provides an ink form roller in a printing press including:

a core;

a first layer surrounding part of the core; and a second layer surrounding part of the first layer, the second layer having a durometer hardness greater than the first layer.

The present invention also provides an ink form roller in a printing press including:

a core; and a layer surrounding the core, the layer having a hardness between about 25 Shore A durometer and about 40 Shore A durometer, the layer having an outer surface, the outer surface having a surface roughness of about 30 micro-inches or less.

The present invention provides a method for designing an ink form roller including the steps of:

selecting a material for a layer of an ink form roller, the material having between 25 and 40 Shore A durometer hardness;

making an ink form roller having a layer of the material; and lowering the surface roughness of an outer surface of the layer through a finishing operation.

The present invention also provides a method for printing including the steps of:

providing an ink form roller, the ink form roller including a first layer surrounding part of a core and a second layer surrounding part of the first layer, the second layer having a durometer hardness greater than the first layer;

providing a plate cylinder having a printing plate mounted on an outer surface of the plate cylinder;

applying ink to the ink form roller; and transferring ink from the ink form roller to the printing plate.

The present invention further provides a method for designing an ink form roller including the steps of:

selecting a material for a core;

selecting a material for a first layer of an ink form roller, the material having a hardness between 25 Shore A durometer and 40 Shore A durometer;

selecting a material for a second layer of an ink form roller, the material having a hardness between 60 Shore A durometer and 100 Shore A durometer; and making an ink form roller by surrounding part of the core with the first layer and surrounding part of the first layer with the second layer.

BRIEF DESCRIPTION OF THE DRAWINGS

A preferred embodiment of the present invention will be elucidated with reference to the drawings, in which.

DETAILED DESCRIPTION OF THE PREFERRED EMBODIMENTS

High line loads may exist when a hard roller, for example, a roller having a hardness between 60 to 90 Shore A durometer, contacts another roller or plate cylinder. The line load is the radial load on the core of the roller per inch along the axis resulting from nip pressure. Conventional hard rollers may have a line load of, for example, 15 to 25 pounds per linear inch of length of the roller. The high line loads deflect the roller cores and place a large amount of stress on the roller hangers. However, smooth surface finishes on hard rollers, for example, a surface roughness of 30 micro-inches or less, may be desirable for printing.

Typically, hard rollers are crowned to compensate for the deflection and to attain an even line of contact or stripe from one end of the roll to the other. A crowned roller has a diameter near the ends of the roller that is smaller than a diameter at the longitudinal center of the roller. The crowned rollers require heavier and more costly hangers for support and more costly finishing processes for manufacture of the crown. Setting the crowned rollers may also be more difficult because setting needs to be made simultaneously to two adjacent rollers for uniform alignment.

By utilizing softer rollers, for example, a roller having 25 to 40 Shore A durometer hardness, line loads may decrease to, for example, 1 to 5 pounds per linear inch of width of the roller. However, these softer rollers have rougher surface finishes, for example, a surface roughness of 50 micro-inches or more, which may adversely affect print quality.

Figure 1:
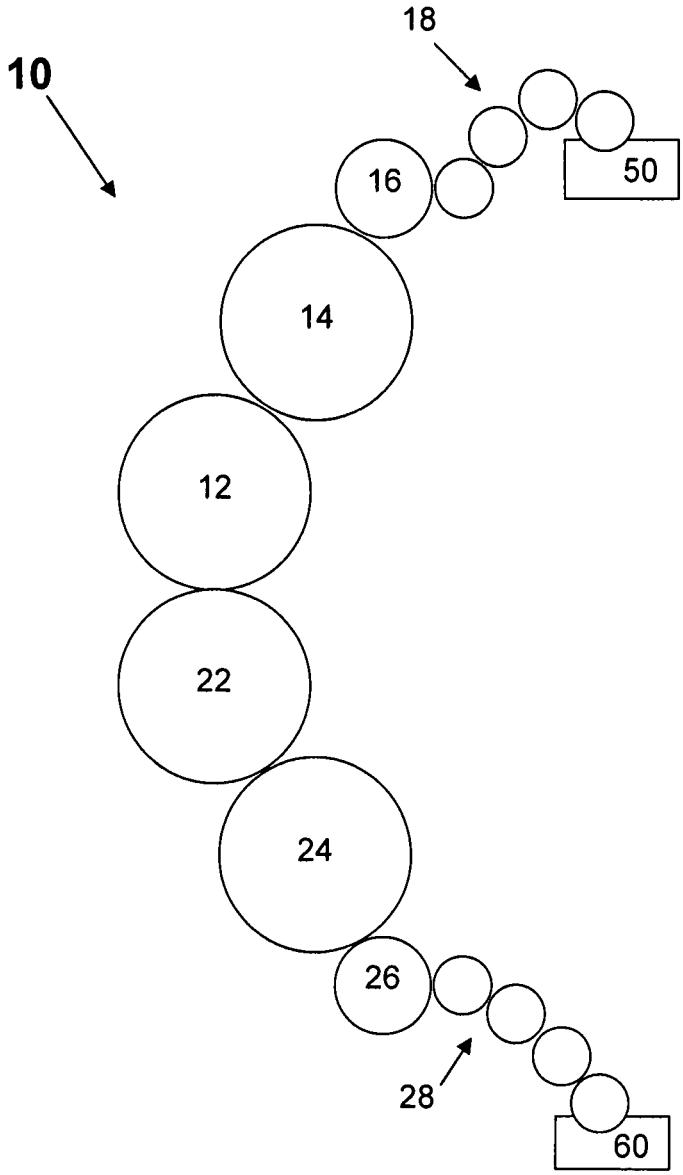
FIG. 1 shows a printing unit having an ink form roller according to the present invention.

FIG. 1 shows a printing unit 10 having ink form rollers 16, 26 according to the present invention. The printing unit 10 includes blanket cylinders 12, 22, plate cylinders 14, 24 and ink form rollers 16, 26. Inking units 18, 28 transport ink from reservoirs 50, 60 to ink form rollers 16, 26 respectively.

Figure 2:
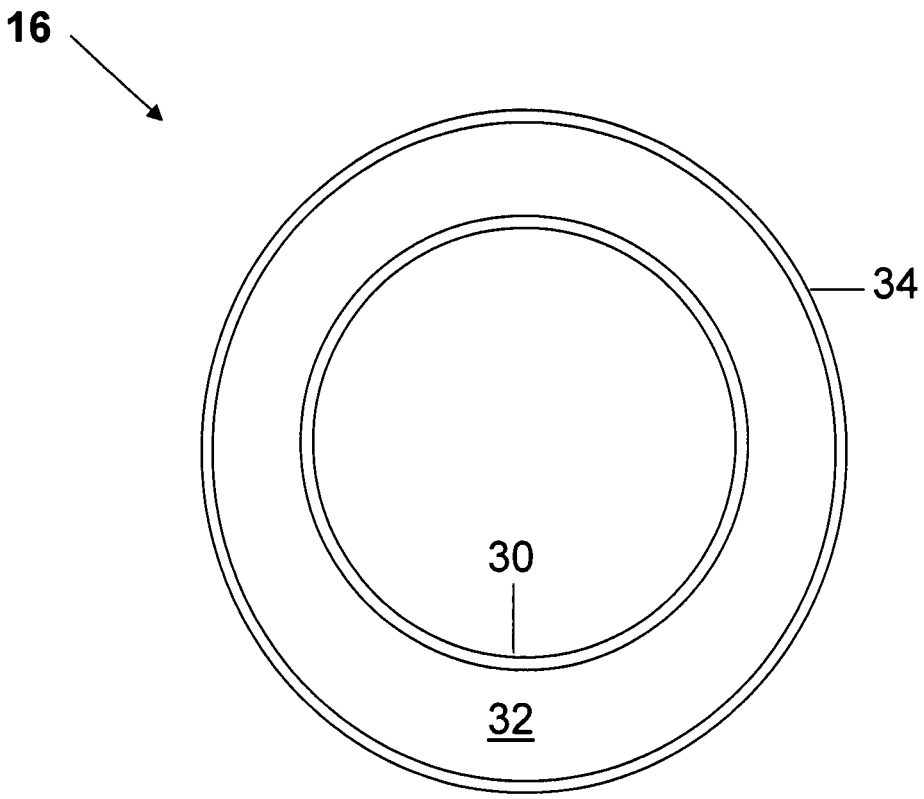
FIG. 2 shows a cross section of the ink form roller shown in FIG. 1.

FIG. 2 shows a cross section of ink form roller 16 according to the present invention. The ink form roller 16 includes a core 30 formed of a rigid material, for example steel or a composite. An inner layer 32 is mounted on at least a portion of core 30. Inner layer 32 may be an elastomer material fabricated to have a hardness of, for example, 25 to 40 Shore A durometer. An outer layer 34 is mounted on at least a portion of inner layer 32. Outer layer 34 may be an elastomer material fabricated to have a hardness of, for example, 60 to 100 Shore A durometer, preferably, 80 Shore A durometer. The outer layer 34 may be, for example, between 0.010 and 0.3125 inches thick.

Ink form rollers 16, 26 having for example, a 0.050 inch thick outer layer 34 with 80 Shore A durometer hardness, mounted on a 30 Shore A durometer hardness inner layer 32, typically result in a line load of two to five pounds per linear inch and a surface roughness of 30 micro-inches or less. The increased smoothness in outer layer 34 splits ink between ink form rollers 16, 26 and plate cylinders 14, 24 (FIG. 1) with a finer and more uniform pattern, thereby reducing mottle. The hard outer layer 34 allows for a smooth surface finish through the grinding operation, while roller 16 maintains a lower line load due to softer inner layer 32. Thus, mottle may be reduced while low line loads are maintained.

Finishing operations are performed to obtain the desired outer diameter and remove any existing run out. Smooth surface finishes typically have a surface roughness of less than 30 micro-inches and can be as low as five micro-inches. Standard 25 to 40 Shore A durometer compounds usually have a surface roughness greater than 50 micro-inches. Achieving a smooth surface finish on low durometer rollers may be difficult because finishing operations, for example, grinding, tear out chunks of the soft material leaving a rough surface. Hard outer layer 34 allows for a smoother surface after finishing operations. Thus, ink form rollers 16, 26 result in smoother printing and less mottle when ink is split.

Figure 3:
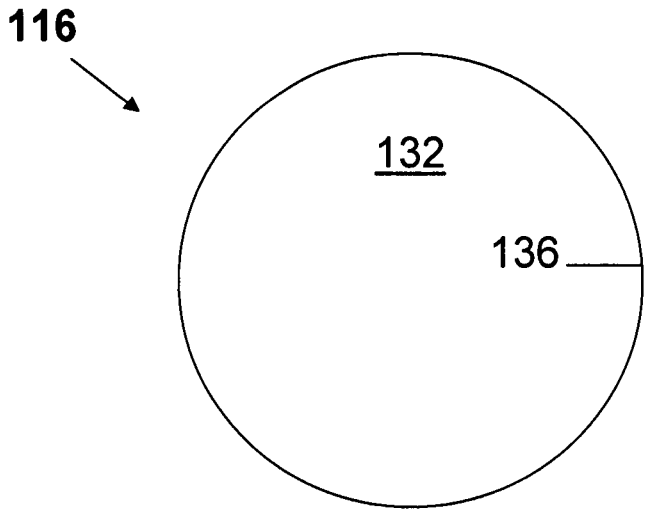
FIG. 3 shows a cross section of a second preferred embodiment of the ink form roller.

A second preferred embodiment of the present invention includes a roller 116 having a layer 132 of elastomer with 25 to 40 Shore A durometer hardness as shown in FIG. 3. Finishing operations, including grinding the elastomer while the elastomer is at, near or below the glass transition zone temperature, improve qualities of surface 136, for example, surface roughness. The elastomer may be cooled to a temperature at, near or below the glass transition zone temperature prior to grinding. Preferably, roller 116 has a line load of one to five pounds per linear inch, preferably, one to two pounds per linear inch, and a surface roughness of 30 micro-inches or less. Thus, roller 116 maintains low line loads and has a smooth surface 136.

Figure 4:
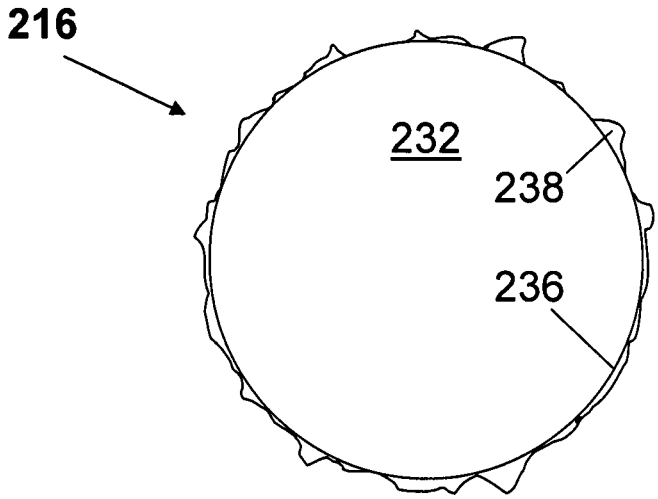
FIG. 4 shows a cross section of a third preferred embodiment of the ink form roller.

A third preferred embodiment of the present invention includes a roller 216 having a layer 232 of elastomer with 25 to 40 Shore A durometer hardness as shown in FIG. 4. During post-grinding operations, for example, polishing, very fine sandpaper removes high peaks 238 formed as a result of the grinding operation. Polishing peaks 238 results in a smooth outer surface 236 while roller 216 maintains low line loads. Preferably, roller 216 has a line load of one to five pounds per linear inch, preferably one to two pounds per linear inch, and a surface roughness of 30 micro-inches or less.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. An ink form roller in a printing press comprising:

a hollow core;

a first layer surrounding part of the core, the first layer having a 25 to 40 Shore A durometer hardness; and a second layer surrounding part of the first layer, the second layer having a durometer hardness greater than the first layer;

the ink form roller having a line load between about one pound per linear inch and about five pounds per linear inch during printing.

2. The roller as recited in claim 1 wherein the first layer is an elastomer.

3. The roller as recited in claim 1 wherein the second layer is an elastomer.

4. The roller as recited in claim 1 wherein the second layer is from 0.010 to 0.3125 inches thick.

5. The roller as recited in claim 1 wherein the core is steel or a steel composite.

6. The roller as recited in claim 1 wherein the second layer has a surface roughness of 30 micro-inches or less.

7. The roller as recited in claim 6 wherein the outer surface is a finished outer surface which is finished by maintaining the outer surface at, near or below the glass transition zone temperature during a finishing operation.

8. The roller as recited in claim 6 wherein the outer surface is a finished outer surface which is finished by polishing the outer surface.

9. The roller as recited in claim 8 wherein polishing the outer surface occurs after a grinding operation is applied to the ink form roller.

10. The roller as recited in claim 1 wherein the second layer has a hardness between 60 Shore A durometer and 100 Shore A durometer.

11. The roller as recited in claim 10 wherein the second layer has a hardness of 80 Shore A durometer.

12. A printing press comprising:

a blanket cylinder having a blanket mounted on an outer surface of the blanket cylinder;

a plate cylinder having a printing plate mounted on an outer surface of the plate cylinder, the printing plate contacting the blanket during printing of a substrate; and at least one ink form roller as recited in claim 1, the ink form roller contacting the printing plate and forming a nip therebetween during printing, the line load resulting from pressure applied at the nip.

13. A method for printing comprising the steps of:

providing an ink form roller, the ink form roller including a first layer surrounding part of a hollow core and a second layer surrounding part of the first layer, the second layer having a durometer hardness greater than the first layer;

providing a plate cylinder having a printing plate mounted on an outer surface of the plate cylinder, the plate cylinder forming a nip with the ink form roller;

applying ink to the ink form roller; and transferring ink from the ink form roller to the printing plate, during printing the ink form roller having a line load between about one pound per linear inch and about five pounds per linear inch, resulting from pressure applied at the nip.

14. The method for printing as recited in claim 13 wherein the first layer is an elastomer.

15. The method for printing as recited in claim 13 wherein the second layer is an elastomer.

16. The method for printing as recited in claim 13 wherein the second layer is from 0.010 to 0.3125 inches thick.

17. The method for printing as recited in claim 13 wherein the core is steel or a steel composite.

18. The method for printing as recited in claim 13 wherein the second layer has a surface roughness of 30 micro-inches or less.

19. The method for printing as recited in claim 13 wherein the ink form roller has a line load of about two pounds per linear inch.

20. The method for printing as recited in claim 13 the first layer has a hardness between 25 Shore A durometer and 40 Shore A durometer.

21. The method for printing as recited in claim 13 wherein the second layer has a hardness between 60 Shore A durometer and 100 Shore A durometer.

22. The method for printing as recited in claim 21 wherein the second layer has a hardness of 80 Shore A durometer.

* * * * *